US008424938B1

(12) United States Patent
Li et al.

(10) Patent No.: US 8,424,938 B1
(45) Date of Patent: Apr. 23, 2013

(54) HOIST DEVICE WITH LEVELING AND DISENGAGEMENT MECHANISM

(75) Inventors: Lun-Hui Li, Taoyuan County (TW); Pei-Hsiang Huang, Taoyuan County (TW); Jhih-Jhong Huang, Taoyuan County (TW)

(73) Assignee: Institute of Nuclear Energy Research, Jiaan Village, Longtan, Taoyuan (TW)

( * ) Notice: Subject to any disclaimer, the term of this patent is extended or adjusted under 35 U.S.C. 154(b) by 0 days.

(21) Appl. No.: 13/273,221

(22) Filed: Oct. 13, 2011

(51) Int. Cl.
*B66C 1/10* (2006.01)

(52) U.S. Cl.
USPC ..... 294/67.5; 294/81.3; 294/907

(58) Field of Classification Search ..... 294/67.5, 294/81.3, 81.4, 82.12, 67.21, 86.41, 907; 212/272–274
See application file for complete search history.

(56) References Cited

U.S. PATENT DOCUMENTS 4,138,321 A * 2/1979 Scholz et al. ..... 376/263
4,750,132 A * 6/1988 Pessina et al. ..... 414/751.1
4,905,848 A * 3/1990 Skjonberg ..... 212/274
4,973,094 A * 11/1990 Tana et al. ..... 294/81.21
5,417,464 A * 5/1995 Seaberg et al. ..... 294/206
5,617,964 A * 4/1997 Lucking et al. ..... 212/327
6,048,012 A * 4/2000 Selby et al. ..... 294/81.3
7,497,492 B2 * 3/2009 Gonzalez et al. ..... 294/67.5
7,931,320 B2 * 4/2011 Alway et al. ..... 294/81.3
2009/0285664 A1 * 11/2009 Kim et al. ..... 414/730

* cited by examiner

*Primary Examiner* — Dean Kramer

(57) ABSTRACT

A hoist device with leveling and disengagement mechanism mainly comprises a stand under traditional hoist, a plural number of branches on the stand extending radially outward, a plural number of driving modules on each branch of the stand and being able to connect to a hung object, a plural number of sensing modules on each driving module to sense the operation status for each driving module and continue to output corresponding sensing signal, a control circuit that can output control signals to control each driving module while each sensing module can sense the status of each driving module and feedback to the control circuit to correct the output control signals, allowing each driving module on the stand to level and disengage the hung object, and enabling the hoist to lift the hung object.

6 Claims, 3 Drawing Sheets

HOIST DEVICE WITH LEVELING AND DISENGAGEMENT MECHANISM

BACKGROUND OF THE INVENTION

1. Field of the Invention

The invention is related to a hoist device with leveling and disengagement mechanism. Especially, it refers to a device that can keep the hung object loose and leveled during movement and facilitate pick-and-place operation in limited space.

2. Description of the Prior Art

For the assembly hanging operation in TRR (Taiwan Research Reactor) body or within the other type of narrow space, since the distance between each metal module and the reactor body is only several centimeters and it is unknown if interior modules are connected with each other or deadly locked. Therefore, it is challenging under the limitation of hoist capacity to move modules horizontally from inside to outside of the reactor body without collision.

Currently, there is no designated hanging equipment in construction industry for hanging operation inside TRR body. It is the common type of hoist to be used in the above mentioned hanging operation. Mostly, the hook of the hoist is attached to a plural number of steel cables or iron chains as well as different parts of the hung object, which is kept leveled as much as possible during fastening or buckling. Nevertheless, since there is limited space in the TRR body and it is not easy to be clear about the status of fixation for each module, it is frequently to have the hung object to remain partially locked or too tightly clamped without being timely noticed. Moreover, common hoist equipment has relatively fast moving speed.

Thus, when a hoist is directly used to hoist an object up quickly, due to the difference in tension of attachment at different parts of the hung object or unnoticed deadly locked module, it tends to generate serious stretching or over load that could cause vibration and inclination, and it is hard to prevent shaking or skew. Such shaking or skew state could cause collision between the hung object and TRR body interior and lead to damage or dead lock. Therefore, the above mentioned hoist equipment is difficult to assure that the hung object be loosened before hanging operation, and then remain leveled during ascending. This makes the hanging operation very difficult in limited space in TRR body.

In view of the drawbacks with traditional hanging equipment when it is operating in limited space, the inventor came up with the invention that provides improvement.

SUMMARY OF THE INVENTION

The main objective for the invention is to provide a hoist device with leveling and disengagement mechanism that can keep the hung object leveled and loose with respect to peripheral parts. The invention aims to facilitate hoist operation in limited space.

Another objective for the invention is to provide a hoist device with leveling and disengagement mechanism that can instantly detect the operation status of each module and accordingly modify the operation condition for each driving module to maintain constant operation speed and effectively prevent inclination or overload during detachment process.

To achieve the above objectives and performance, the adopted technical approach includes: a stand with a plural number of branches extending to periphery; a plural number of driving modules on the branches of the stand and being able to connect to the hung object; a plural number of sensing module on the driving module to sense the operation status for each driving module and continuously output corresponding sensing signals; a control circuit connecting via signal wires to sensing modules and driving modules and having at least a digital/analog converter, a analog/digital converter and a processing unit. The processing unit according to operation condition can output a digital control signal, which is converted into an analog signal via digital/analog converter, to control the operation of each driving module via signal wires. Each sensing module can sense the operation status for each driving module and generate an analog sensing signal via signal wires and the analog/digital converter and then feedback to the processing unit. This allows the processing unit to correct the output digital control signal and order each driving module on the stand to hoist the hung object with leveling.

According to the above structure, the sensing module at least comprises a pressure sensing component, a flow sensing component and a displacement sensing component.

According to the above structure, the driving module is a hydraulic drive.

According to the above structure, the hydraulic drive comprises a liquid pump, a servo control valve and an actuator.

According to the above structure, there is a limit switch between the servo control valve and the actuator.

According to the above structure, the processing unit is a computer with I/O interface.

According to the above structure, the plural number branches extend out radially from the center.

DETAILED DESCRIPTION OF THE INVENTION

Figure 1:
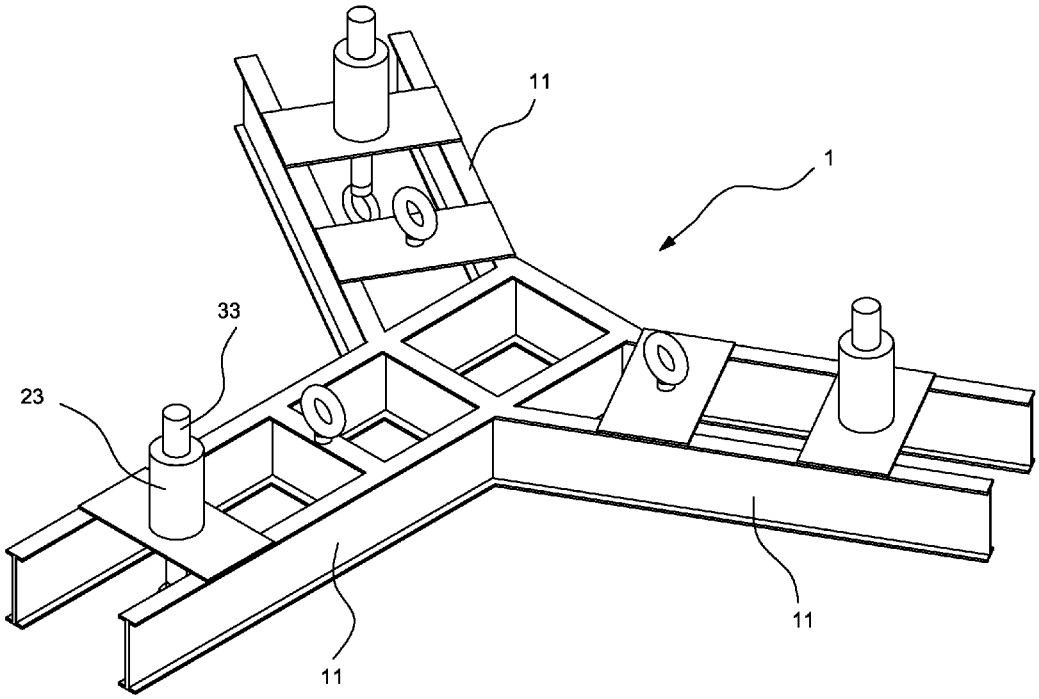
FIG. 1 is the configuration diagram for the stand and the driving module of the invention.
Figure 2:
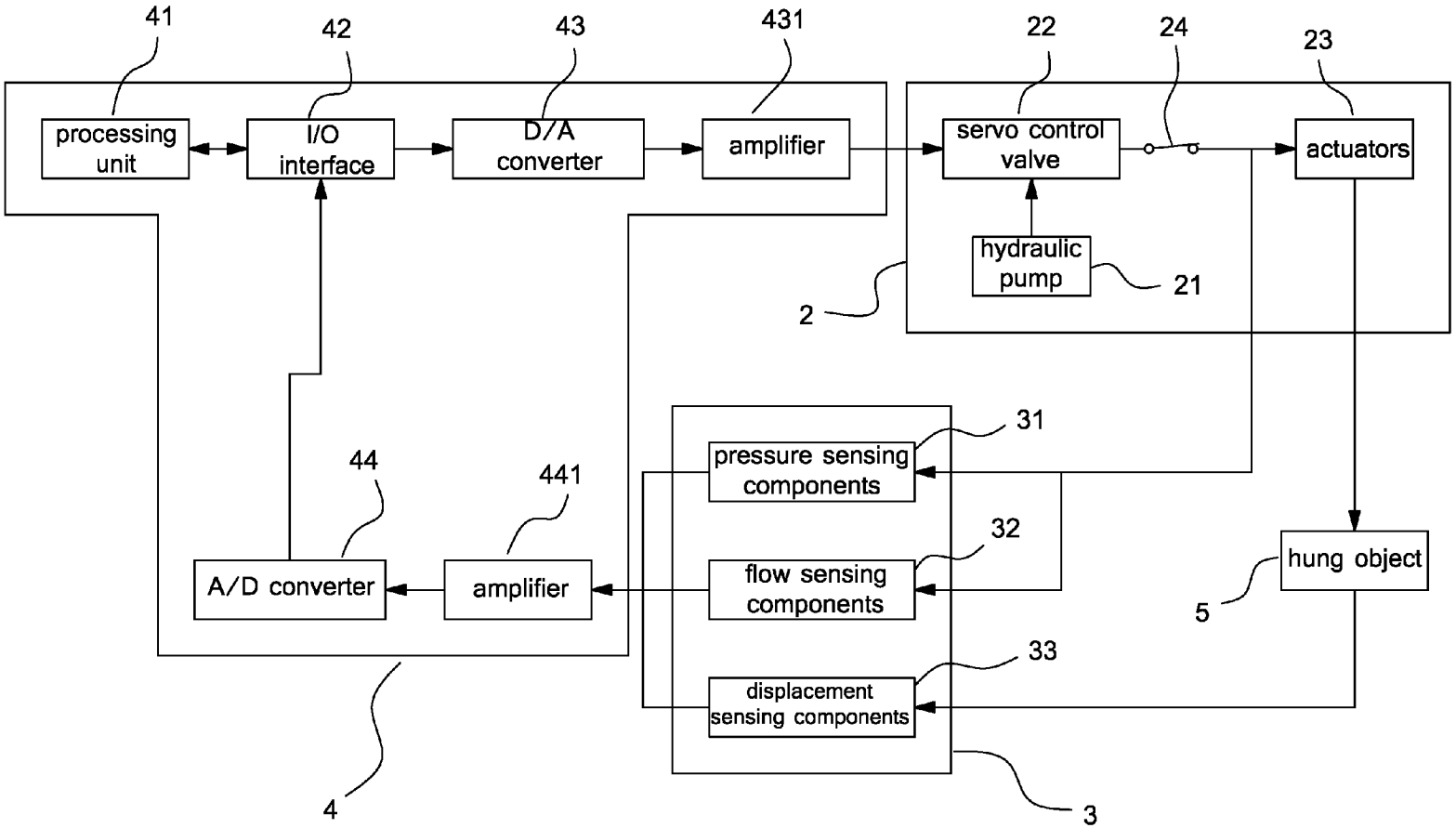
FIG. 2 is the circuit diagram for the control circuit and the driving module of the invention.

To obtain better understanding of the objectives, effects and characteristics for the invention, the explanation according to attached figures is provided below:

Please refer to FIG. 1 and FIG. 2. It can be known that the structure for the invention mainly comprises: stand 1, driving module 2, sensing module 3 and control circuit 4. Among these, the stand 1 has a plural number of branches 11 extending to periphery radially. The driving module 2 is a hydraulic driving device that comprises a plural number of actuators 23 (hydraulic cylinder) on each branch 11, related hydraulic pump 21 and servo control valve 22. The plural number of sensing modules 3 comprise pressure sensing components 31 (or load cell) and flow sensing components 32 (e.g. turbine meter) on hydraulic pump 21 and servo control valve 22 and displacement sensing components 33 (e.g. optical ruler) on actuator 23 (hydraulic cylinder) to sense the operation status of each driving module 2 and continuously output detected analog sensing signal (pressure, flow and displacement, velocity) as feedback signal.

The control circuit 4 connects via signal wires to the sensing modules 3 and driving modules 2 and there are at least a D/A (digital/analog) converter 43, an A/D (analog/digital) converter 44 and a processing unit 41 and an I/O interface 42. The processing unit 41 (e.g. computer with I/O interface 42) can be entered by operator with necessary data (displacement, velocity or flow rate) and then output a digital control signal, which through the I/O interface 42 goes to the D/A (digital/analog) converter 43 and is converted into an analog control signal, and is amplified by an amplifier 431. This is to control the hydraulic pump 21 and the servo control valve 2 via signal wires to drive each driving module 2 and further activate the stand 1.

The analog sensing signal detected by previously mentioned sensing modules 3 for the operation status of each driving module 2 can be transmitted to the amplifier 441 and be amplified, and then be converted by the A/D (analog/digital) converter 44 into a digital sensing signal, and then feedback via I/O interface 42 to the processing unit 41. The processing unit 41 can compare the data (displacement, velocity or flow rate) entered by operator to the feedback signals and after obtaining the difference output a corrected digital control signal, which can be converted via the D/A (digital/analog) converter 43 into a corrected analog control signal, and then via signal wires control each driving module 2 to command each driving module 2 to level and hoist the hung object 5.

Figure 3:
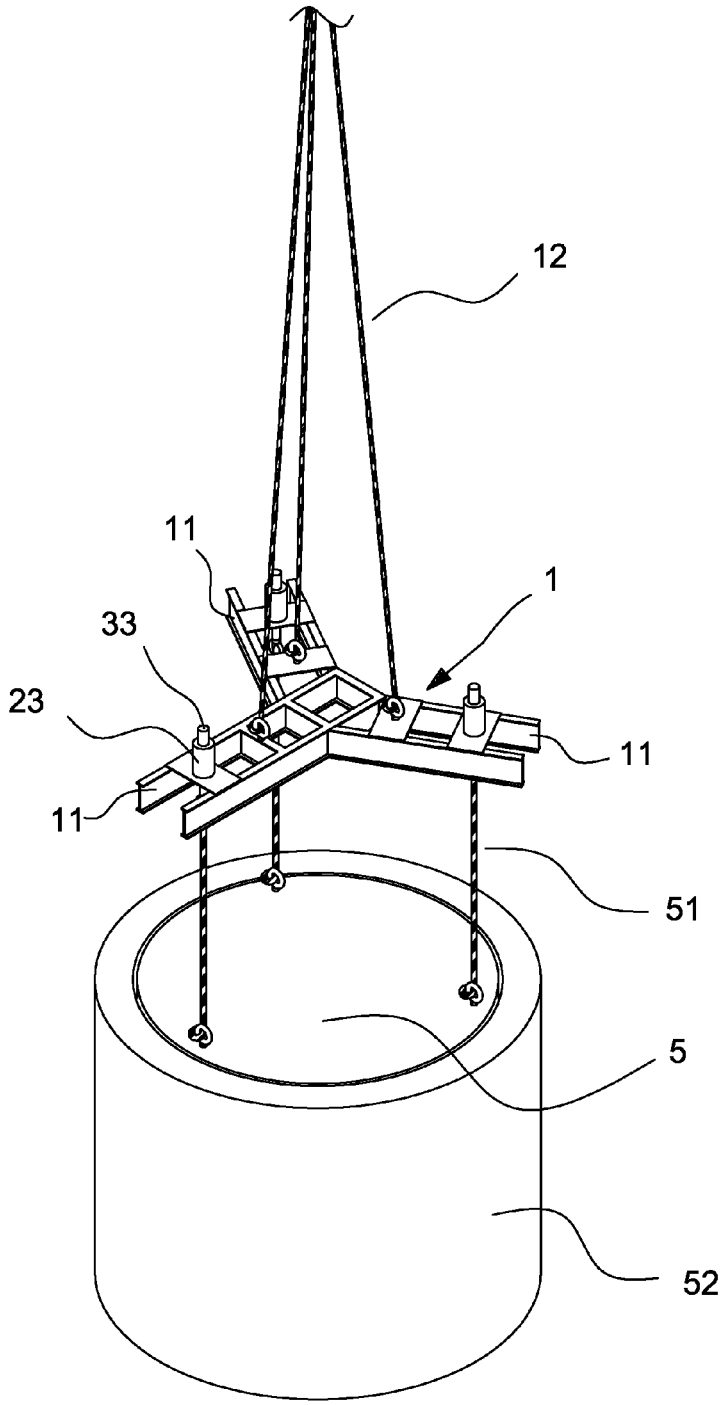
FIG. 3 is the illustration of an application of the invention.

Please refer to FIG. 3. It can be known that in an actual application of the invention, the stand 1 is installed on external hanging equipment (e.g. hoist, not shown) via steel cables 12 (or chains). The actuator 23 on the driving module 2 (hydraulic driving device) can connect with the hung object 5 via steel cables 51 (or chains). In the beginning, the stand 1 is fixed onto predetermined locations (top periphery) above the neighboring components 52 (e.g. TRR body) on the side of the hung object 5. After the operator can enter the default displacement (approximately 5~10 cm), the processing unit 41 (computer) of the control circuit 4 will output a digital control signal via the I/O interface 42. The digital control signal is converted via the D/A (digital/analog) converter 43 into an analog control signal and amplified by the amplifier 431. Then the hydraulic pump 21 for each driving module can control actuator 23 via servo control valve 22. During the operation process for the actuator 23, each sensing module 3 continues to feedback the detected analog sensing signals for pressure, flow rate and displacement to control circuit 4. The signals will be amplified by the amplifier 441 and converted by the analog/digital converter 44 into digital sensing signals, which via the I/O interface 42 will feedback to the processing unit 41. The processing unit 41 will compare and analyze the signals with operator entered data (displacement, velocity or flow rate) and output corrected digital control signals via I/O interface 42. The corrected digital control signals can be converted via the D/A (digital/analog) converter 43 into analog control signals and be amplified by the amplifier 431 to control the openness for each servo control valve 22 and further adjust each actuator 23 operation. As a result, the hung object 5 can be leveled and lifted up by the operator entered displacement (5~10 cm). This action allows complete disengagement between the hung object 5 and neighboring modules 52 to complete the formal disengagement process before the lift. After that, the hoist operation is enabled by steel cables 51 (or chains) fast lifting the stand 1 and therefore the hung object 5 is immediately lifted up.

In the above structure for the invention, between the servo control valve 22 and the actuator 23 a limit switch 24 can be installed if necessary. During the above operation for the driving module 2, the limit switch 24 allows each actuator 23 to keep below the upper limit for pressure and flow rate via the feedback sensing signals from each sensing module 3. If the upper limit for default pressure and flow rate has been exceeded, the limit switch 24 will be activated to shut off the servo control valve 22 to stop operation for each actuator 23 to assure no dead lock for the hung object 5.

In summary, the hoist device with leveling and disengagement mechanism can achieve disengagement of the hung object before hoisting operation and maintain leveling and stable hoisting operation. It is indeed a novel and progressive invention. Accordingly, a patent application is filed. However, the above description is only for a preferred embodiment for the invention. Those alteration, modification, change or equivalent replacement extended from the techniques and scope of the invention shall fall into the scope of the claims by the invention.

What is claimed is:

1. A hoist device with leveling and disengagement mechanism comprises at least:

a stand with a plural number of branches extending outward radially;

a driving module installed on each branch of the stand and being able to connect to a hung object;

a plural number of sensing modules on each driving module to sense the operation status for each driving module and continue to output corresponding sensing signals;

a control circuit via signal wires connecting to the sensing module and the driving module and at least comprising a digital/analog converter, an analog/digital converter and a processing unit;

wherein the processing unit outputs digital control signals, which via a digital/analog converter are converted into analog control signals that will via signal wires control the operation for each driving module, wherein the sensing module at least comprises a pressure sensing component, a flow sensing component and a displacement sensing component, wherein each sensing module detects the status of each driving module and generates a digital sensing signal, which via signal wires is converted by the analog/digital converter into an analog sensing signal and then feedbacks to the processing unit for correction of the output digital control signals, and each driving module on the stand levels and hoists the hung object.

2. As described in claim 1 for a hoist device with leveling and disengagement mechanism, the driving module is a hydraulic driving device.

3. As described in claim 2 for a hoist device with leveling and disengagement mechanism, the hydraulic driving device comprises a hydraulic pump, a servo control valve and an actuator.

4. As described in claim 3 for a hoist device with leveling and disengagement mechanism, between the servo control valve and the actuator there is a limit switch.

5. As described in claim 1 for a hoist device with leveling and disengagement mechanism, the processing unit is a computer with I/O interface.

6. As described in claim 1 for a hoist device with leveling and disengagement mechanism, the plural number of branches of the stand extend outward radially from the center of the stand.

* * * * *